US008845970B2

(12) United States Patent
Muderick et al.

(10) Patent No.: US 8,845,970 B2
(45) Date of Patent: Sep. 30, 2014

(54) HYGIENE PRODUCT DISPOSAL APPARATUS AND METHOD OF USE

(71) Applicant: Xela Innovations, LLC, Glendale, WI (US)

(72) Inventors: Todd J. Muderick, Whitefish Bay, WI (US); Kenneth J. Muderlak, Milwaukee, WI (US)

(73) Assignee: Xela Innovations, LLC, Glendale, WI (US)

( * ) Notice: Subject to any disclaimer, the term of this patent is extended or adjusted under 35 U.S.C. 154(b) by 0 days.

(21) Appl. No.: 13/828,410

(22) Filed: Mar. 14, 2013

(65) Prior Publication Data

US 2014/0117114 A1 May 1, 2014

Related U.S. Application Data

(60) Provisional application No. 61/719,635, filed on Oct. 29, 2012.

(51) Int. Cl.
*A61L 9/04* (2006.01)
*B65D 25/02* (2006.01)

(52) U.S. Cl.
CPC ..... *B65D 25/02* (2013.01)
USPC ..... 422/120; 422/5; 239/274

(58) Field of Classification Search
USPC ..... 422/120, 5; 239/274
See application file for complete search history.

(56) References Cited

U.S. PATENT DOCUMENTS 7,696,711 B2 * 4/2010 Pollack et al. ..... 318/466

* cited by examiner

*Primary Examiner* — Sean E Conley
(74) *Attorney, Agent, or Firm* — Whyte Hirschboeck Dudek S.C.

(57) ABSTRACT

A product disposal apparatus includes a bin for receiving discarded products, a cover assembly including a lid positioned at least partially over the bin, a power module receiving pocket situated in the cover assembly for receiving one of a power module and a power shell module, and a fragrance receiving pocket situated in the cover assembly for receiving one of a fragrance module and a fragrance shell module. The lid is rotatably secured to the cover assembly and has a partial cylindrical shape having a front portion and a back portion, and wherein a back portion of the lid is positioned to at least partially cover the bin opening as the lid is rotated into an open position.

19 Claims, 16 Drawing Sheets

HYGIENE PRODUCT DISPOSAL APPARATUS AND METHOD OF USE

FIELD

The present disclosure relates to disposal receptacles, and more specifically to a hygiene product disposal receptacle with optional integrated fan and fragrance modules.

BACKGROUND

Hygiene product disposal units receive and temporarily house personal hygiene products. Most commonly, such disposal units reside in public bathrooms to provide a sanitary receptacle that houses used feminine hygiene products, such as tampons, etc; however, such disposal units can also be used to house syringes, diapers, etc. Such units usually include a storage chamber and a cover. The cover can include a partition secured thereto to form a "V-shaped" insertion pocket. The partition serves to reduce the visibility of the contents of the storage chamber when inserting subsequent used hygiene products. However, the partition can consume substantial storage space in the storage chamber, thereby requiring servicing of the unit more frequently.

In addition, such disposal units often include a hand-operated cover that requires a user to touch the unit, which can be undesirable. Although automated units exist, such units require purchasing with the necessary motors and gears to implement the automated operation. This increases the initial purchase cost and prevents the purchaser from later adding the feature if the need or desire arises. In addition, failure of such motors and gears can be difficult to service, often requiring removal of the whole unit from service until a repair is performable. Further, the integration of the electronics that power and control the motor substantially limits the ability to clean and sanitize the unit.

The disposal units typically include waste product, such as blood, sweat, etc., which emits a foul odor. Typically, addressing such foul odors is accomplished using separate wall mounted air fresheners. The use of these air fresheners requires an additional product to be provided and serviced apart from the disposal unit, increasing cost and servicing requirements. In addition, adding a static air freshener to the disposal unit provides a very limited distribution of the air freshener scent. Accordingly, it would be desirable to provide a hygiene product disposal apparatus and method of use that overcomes at least some of these shortcomings.

BRIEF SUMMARY

In at least one embodiment, a product disposal apparatus is provided that includes a bin for receiving discarded products; a cover assembly including a lid, wherein the cover assembly is positioned at least partially over the bin; a power module receiving pocket situated in the cover assembly, for receiving one of a power module and a power shell module; and a fragrance receiving pocket situated in the cover assembly, for receiving one of a fragrance module and a fragrance shell module.

In at least another embodiment, a product disposal apparatus is provided that includes a bin for receiving discarded products; a bin opening provided at a top portion of the bin; a cover assembly positioned at least partially over the bin opening; and a lid rotatably secured to the cover assembly, wherein the lid includes a partial cylindrical shape having a front portion and a back portion, and wherein a back portion of the lid is positioned to at least partially cover the bin opening as the lid is rotated into an open position.

In at least another embodiment, a method of deodorizing a disposal apparatus, such as a feminine hygiene disposal apparatus, is provided that includes providing a bin for receiving discarded products; providing a cover assembly including a lid, wherein the cover assembly is positioned at least partially over the bin; positioning a fragrance module at least partially within the cover assembly; positioning a fan assembly adjacent to the fragrance module; opening the lid to access an interior of the bin by at least one of rotating or lifting the lid; rotating at least one gear engaged by a portion of the lid; and rotating one or more fan blades of a fan situated adjacent to the fragrance module, wherein the fan blades are interconnected with the at least one gear.

Other embodiments, aspects, features, objectives and advantages of the hygiene product disposal apparatus and method of use will be understood and appreciated upon a full reading of the detailed description and the claims that follow.

BRIEF DESCRIPTION OF THE DRAWINGS

Embodiments of the product disposal apparatus and method of use are disclosed with reference to the accompanying drawings and are for illustrative purposes only. The product disposal apparatus and method of use is not limited in its application to the details of construction or the arrangement of the components illustrated in the drawings. The product disposal apparatus and method of use is capable of other embodiments or of being practiced or carried out in other various ways. In the drawings:

FIG. 12 illustrates a cross-sectional view of the fragrance module taken at line 12-12 of FIG. 11;

DETAILED DESCRIPTION

Figure 1:
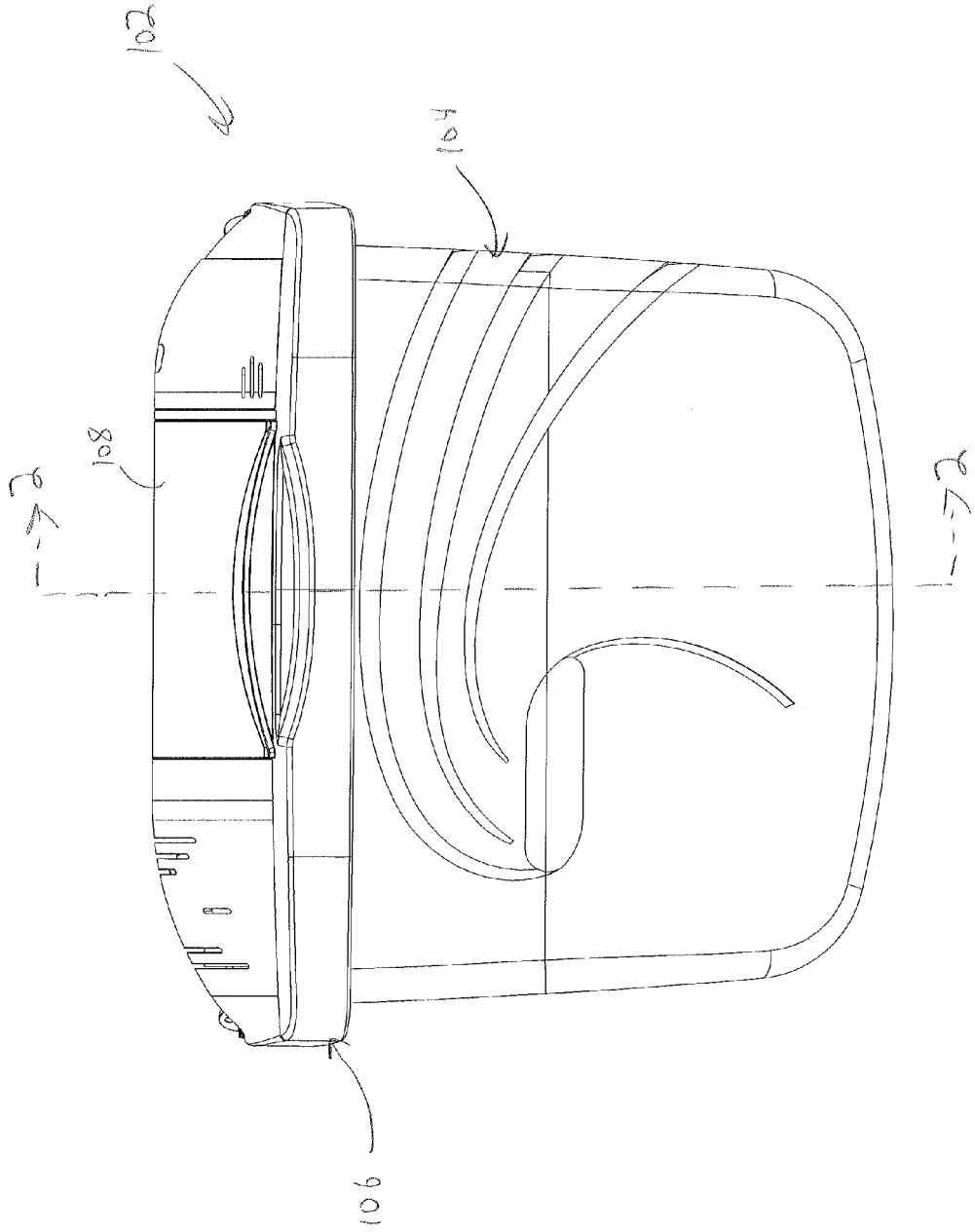
FIG. 1 illustrates a front view of an exemplary disposal apparatus.
Figure 2:
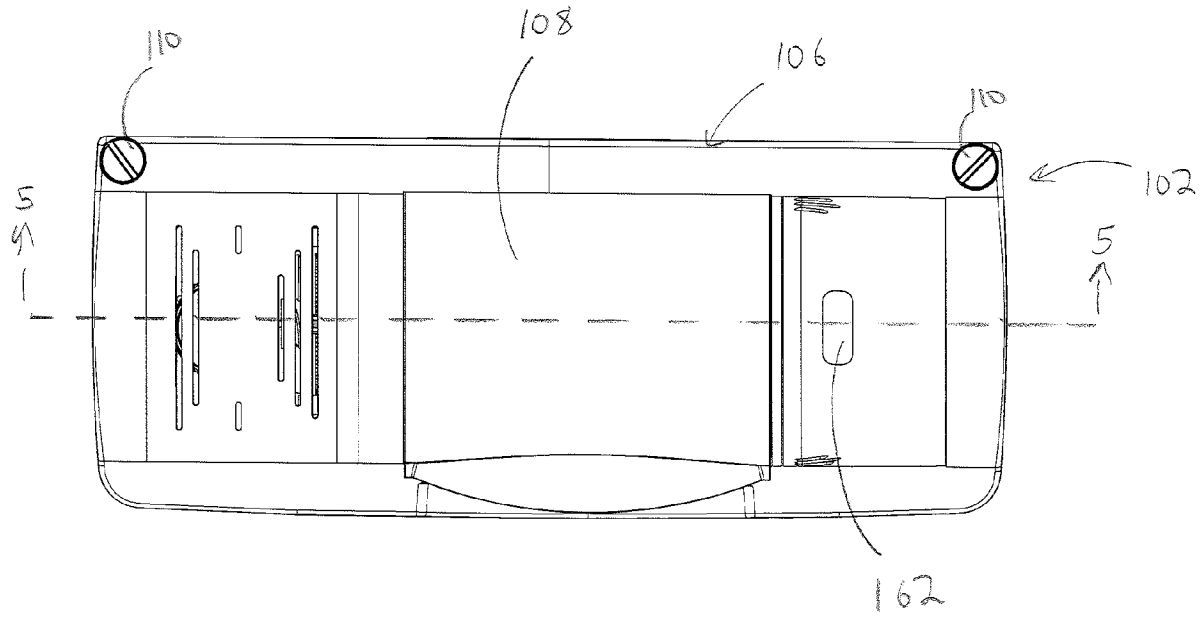
FIG. 2 illustrates a top view of the apparatus.

Referring to FIGS. 1 and 2, illustrated is a front view and a top view of an exemplary disposal apparatus 102. The apparatus 102 includes a bin 104 and a cover assembly 106. The bin 104 receives and stores discarded personal hygiene items, such as tampons, diapers, syringes, etc. The bin 104 can also be used to dispose of various other types of materials, including garbage generally. The bin 104 can include various shapes and sizes to increase or decrease storage and meet space requirements for installation of the apparatus 102. The cover assembly 106 rests atop the bin 104 and includes a movable lid 108. In addition, the cover assembly 106 can be secured to the bin 104 using one or more fastening mechanisms, such as tab key-locks, hinges, and snap features 110 that interconnect to mating portions (not shown) on the bin 104. In some embodiments, lens 162 may cover a sensor, such as a motion sensor, in cover assembly 106.

Figure 3:
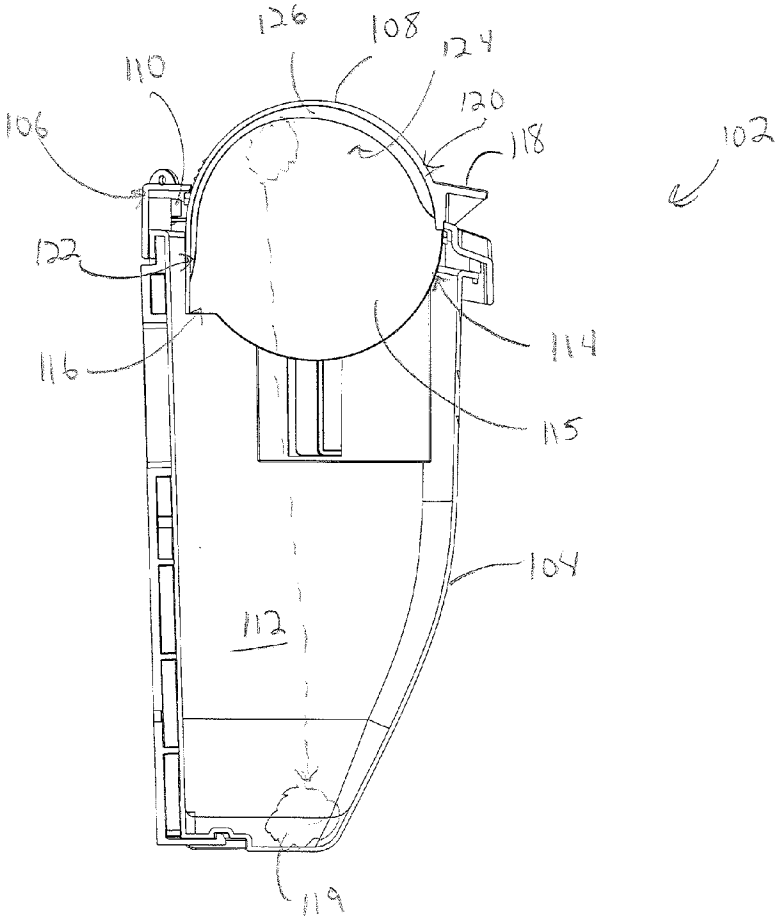
FIG. 3 illustrates a cross-sectional side view of the apparatus with a lid in a closed position taken at line 2-2 of FIG. 1.
Figure 4:
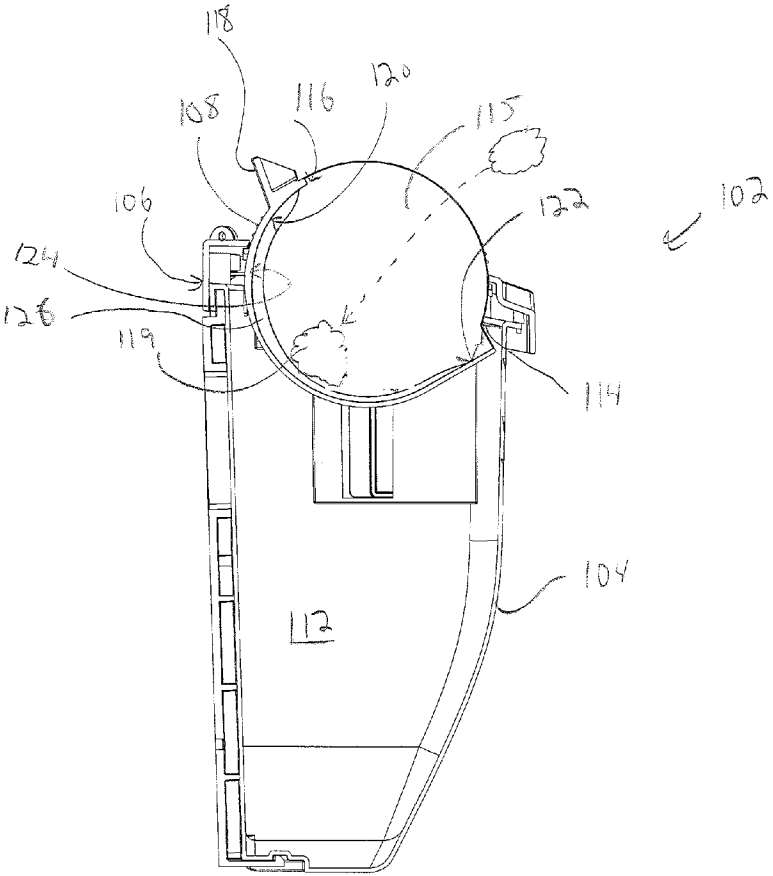
FIG. 4 illustrates a cross-sectional side view of the apparatus similar to that of FIG. 3, but with the lid in an open position.

FIG. 3 illustrates a cross-sectional side view of the apparatus 102 taken at line 2-2 of FIG. 1 with the lid 108 in a closed position. FIG. 4 illustrates a cross-sectional side view of the apparatus 102 similar to that of FIG. 3, but with the lid 108 in an open position. Referring now to FIGS. 3 and 4, the bin includes a storage chamber 112 (see FIG. 3) having a top opening 114. As will be described further below, discarded personal hygiene items and other waste products pass through the top opening 114 and are stored in the storage chamber 112. The cover assembly 106 is situated at least partially atop the bin 104 and includes various portions that extend through the top opening 114. The lid 108, as shown, is rotatably securable to the cover assembly 106, although other securing configurations can be utilized, such as a hinged connection. In at least some embodiments, the lid 108 is substantially cylindrically-shaped having a right side portion 115, a left side portion 117 (FIG. 6), and a lid opening 116. A handle 118 can be included to assist with opening the lid 108. The lid 108 further includes a front portion 120 and a back portion 122. Right side portion 115, left side portion 117, front portion 120 and back portion 122 define a hollow cavity accessible by lid opening 116. Referring still to FIGS. 3 and 4, it can be seen that rotating the lid 108 from a closed position to an open position results in the back portion 122 entering or further entering the storage chamber 112. In addition, the front portion is also moved to approach the storage chamber 112 as well.

During use, the lid 108 is placed into an open position, as shown in FIG. 4, and discarded material 119 is placed into the lid 108 through the lid opening 116. Due to the substantially cylindrical configuration of the lid 108, the existing contents of the storage chamber 112 are partially, substantially, or completely blocked from view. In addition, the substantially cylindrical configuration of the lid 108 minimizes the necessary space in the storage chamber 112 that is required to open and close the lid 108. As seen in FIG. 3, when the lid 108 is in a closed position, the lid opening 116 is exposed to the storage chamber 112, thereby allowing the discarded material 119, subsequently placed in the lid 108, to fall into the storage chamber 112 of the bin 104 for storage. An inner lid wall 124 can include one or more spaced ridges 126 to provide a raised surface for receiving the discarded material 119 and limit adhesion of the discarded material 119 to the inner lid wall 124.

Figure 5:
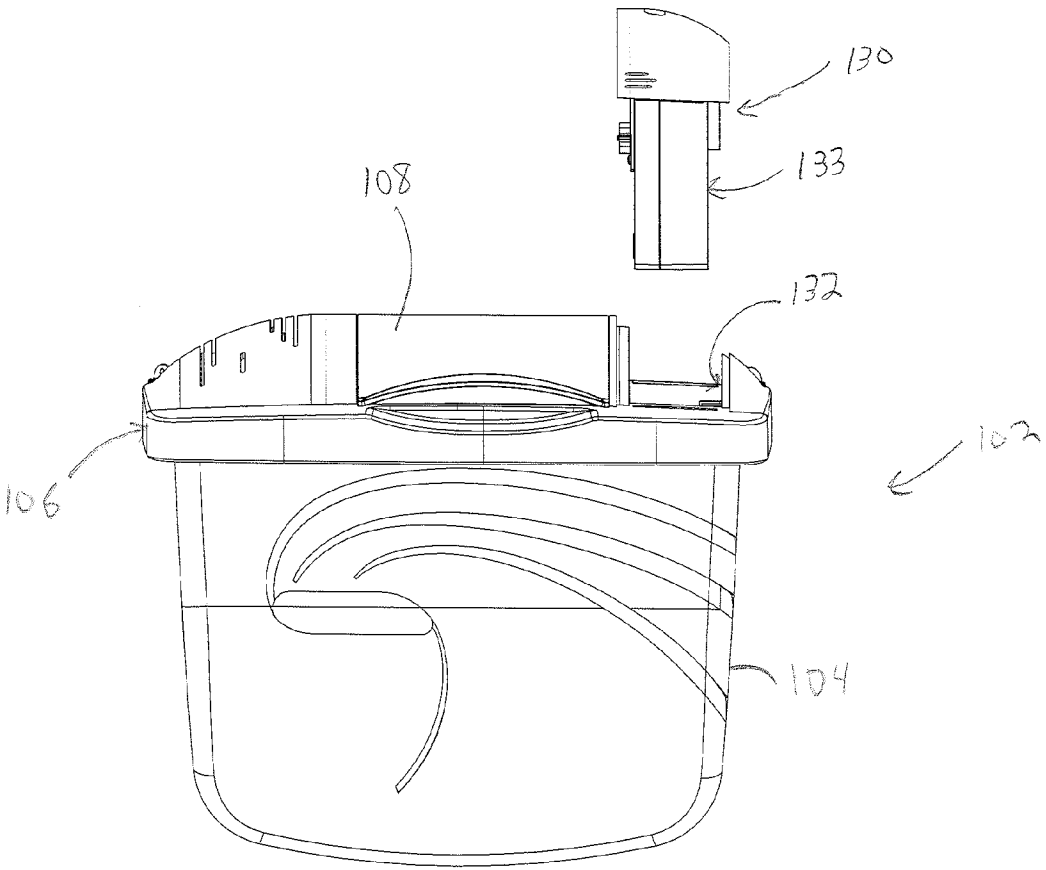
FIG. 5 illustrates a front view of the apparatus with an exemplary power module removed from the apparatus.
Figure 6:
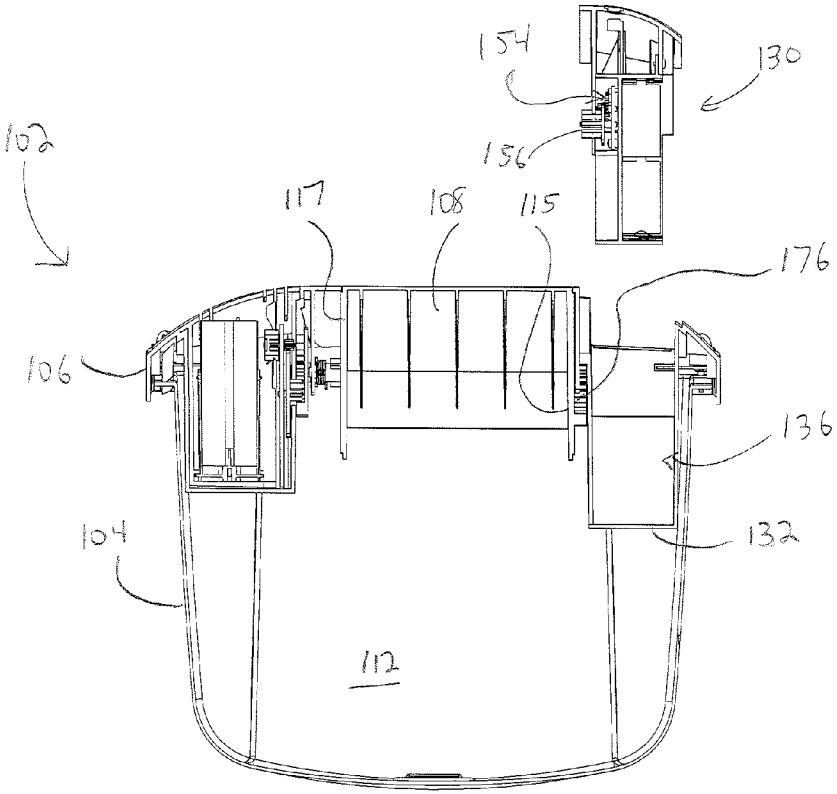
FIG. 6 illustrates a cross-sectional front view of the apparatus shown in FIG. 5 taken along a line similar to line 5-5 of FIG. 2.
Figure 9:
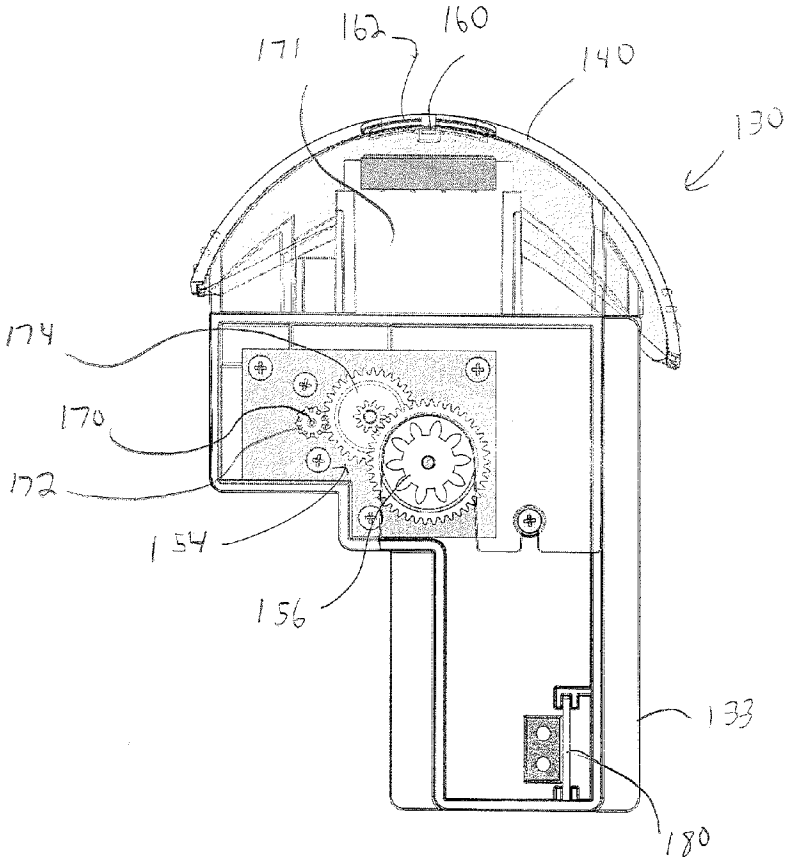
FIG. 9 illustrates a right side view of the power module.
Figure 10:
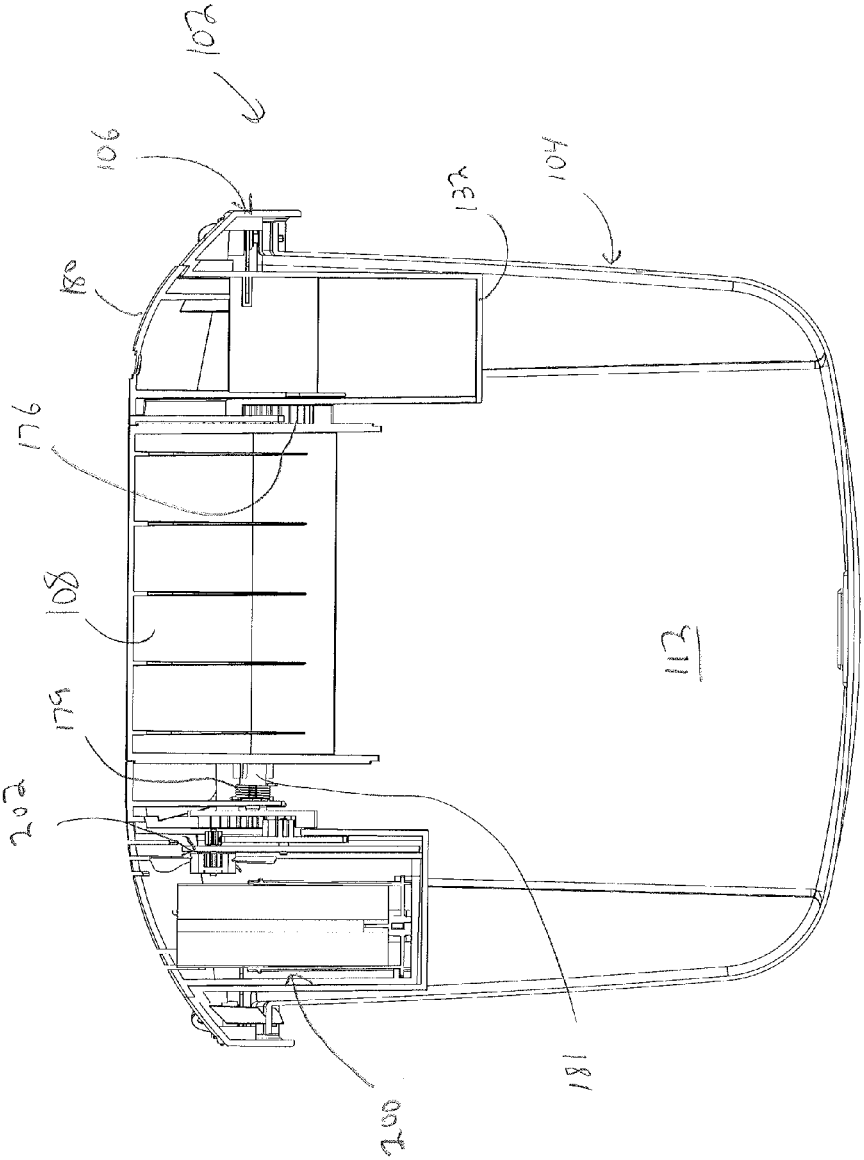
FIG. 10 illustrates a cross-sectional front view of the apparatus of FIG. 1 taken along a line similar to line 5-5 of FIG. 2 with an exemplary blank cover installed in place of the power module.

Referring to FIG. 5, a front view of the apparatus 102 is illustrated with an exemplary power module 130 removed from a power module receiving pocket 132, which is formed in the cover assembly 106 of the apparatus 102. The power module 130 provides an optional lid opening and closing mechanism that can operate the lid 108 automatically. The power module 130 includes a power housing 133 that supports various components of the power module 130. The power module receiving pocket 132 is configured to accommodate one of the power housing 133 and a power shell module 134 (FIG. 10). FIG. 6 illustrates a cross-sectional front view of the apparatus 102 taken along a line similar to line 5-5 of FIG. 2 with the power module 130 displaced from the cover assembly 106. As shown, the power module receiving pocket 132 includes a cavity 136 sized and shaped to receive one of the power module 130 and a power shell module 134. Power gear assembly 154, power engaging gear 156 and arced inverse gear surface 176 are further illustrated in FIG. 9.

Figure 7:
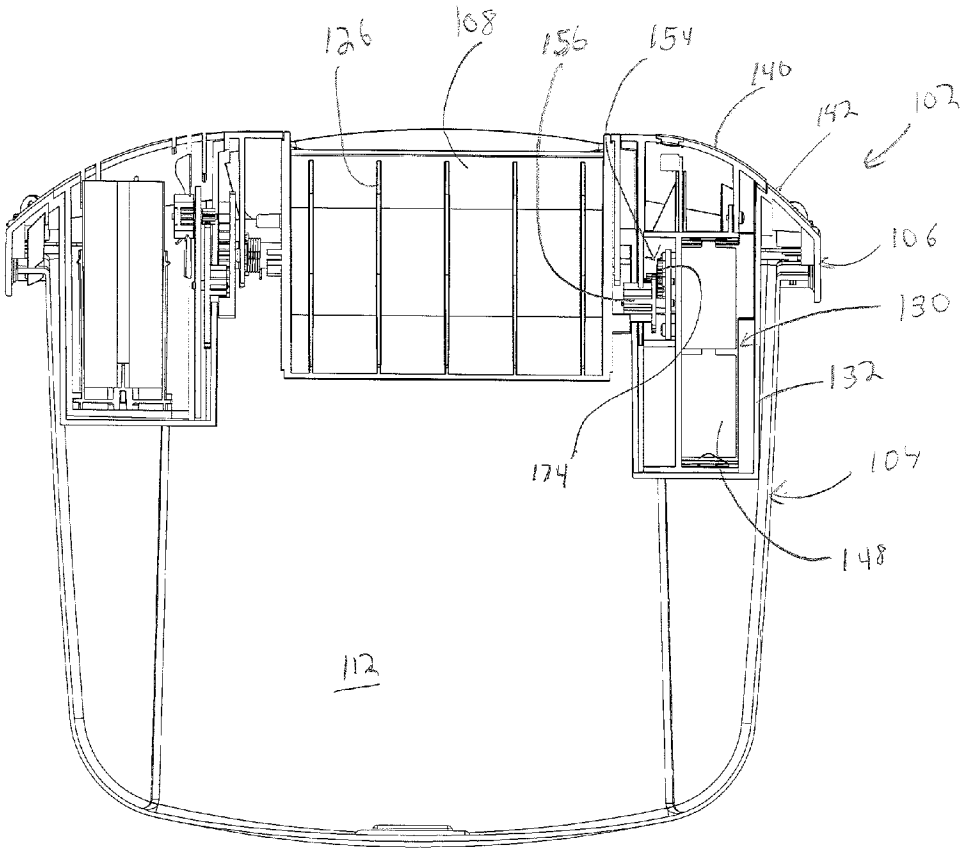
FIG. 7 illustrates a cross-sectional front view of the apparatus in FIG. 1 taken along line 5-5 of FIG. 2.

FIG. 7 illustrates a cross-sectional front view of the apparatus 102 taken along line 5-5 of FIG. 2 with the power module 130 installed in the cover assembly 106 and containing batteries 148. As shown, the power housing 133 includes a power cover portion 140 that is, in at least some embodiments, sized and shaped to conform to the upper surface 142 of the cover assembly 106 to provide an aesthetic match. Referring still to FIG. 7, inner lid wall 124 includes a plurality of ridges 126. Also shown in FIG. 7 is power gear assembly 154 with intermediate gear 174 and power engaging gear 156.

Figure 8:
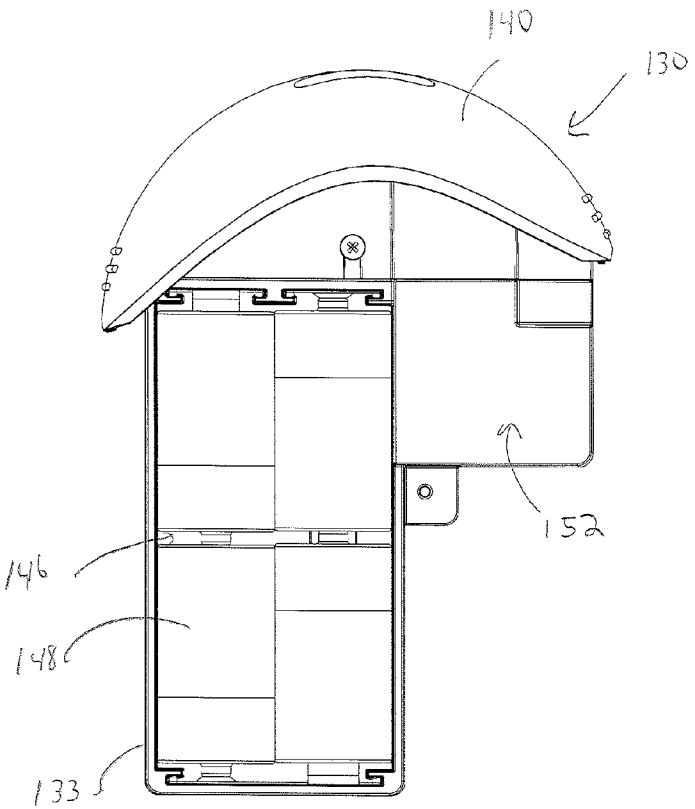
FIG. 8 illustrates a left side view of the power module.

Referring to FIG. 8, a left side view of the power module 130 is illustrated. As shown, the power module 130 includes a power supply cavity 146 for receiving a power supply, such as one or more batteries 148. In addition, power module 130 includes an electronic controller (not shown) situated in a controller housing portion 152. The electronic controller provides electronic control for the various components in the power module 130, and can include one or more mechanisms for electronic control, such as a circuit board 171 (FIG. 9) with one or more integrated chips (not shown). Referring to FIG. 9, a right side view of the power module 130 is illustrated. As discussed above, the power module 130 provides for automatic operation, such as "hands-free" operation, by opening and closing the lid 108. A mechanical engagement of the power module 130 with the lid 108 facilitates the operation of the lid 108 when requested. Such request can be provided by one or more of various sensing mechanisms, such as a sensor (e.g., motion, infra-red, Object in View, ultrasonic, etc.) and a remote button (e.g., foot pedal, etc.). For example, a motion sensor 160 can be provided in the power cover portion 140 positioned under a lens 162. The motion sensor 160 is interconnected with the electronic controller to actuate the lid when motion is present adjacent the lens 162. In addition, the power module 130 can also include a volume sensor 180 (FIG. 9) that senses when the bin 104 has filled with discarded materials to a specific level and can provide illumination of an LED on the cover assembly 106 or other notification that the bin 104 is in need of emptying.

The power module 130 further includes an electric motor (not shown) having an output shaft 170 secured to a motor shaft gear 172. Power from the electric motor can be transferred to rotational movement of the lid 108 in numerous manners, such as gears, belts, etc. In at least some embodiments, the power gear assembly 154 includes an intermediate gear 174 that engages both the motor shaft gear 172 and a power engaging gear 156, noting that the power engaging gear 156 and the intermediate gear 174 each include multiple geared portions secured together. Further, the power engaging gear 156 is configured to engage an arced inverse gear surface 176 (FIG. 6) that is secured to or formed with the right side portion 115 of the lid 108. The inverse gear surface 176 extends in an arc along the right side portion 115 to rotate the lid 108. A return spring 179 (FIG. 10) is provided to bias the lid 108 back to a closed position after opening. The return spring 179 can be positioned over an end rod 181 (FIG. 10) secured to the left side portion 117 of the lid 108, wherein the end rod 181 provides a pivoting point for the lid 108. A similar end rod can be provided on the right side portion 115 as well to support the lid 108 and allow rotation.

The mating configuration of the power module 130 and the lid 108 is provided to allow the apparatus 102 to function with or without the power module 130, as well as to allow for easy conversion of the apparatus 102 from a non-powered apparatus to a powered apparatus. In particular, the configuration of the power engaging gear 156 with the inverse gear surface 176 provides an interconnection that can be completed upon insertion of the power module 130 into the power module receiving pocket 132, as the power engaging gear 156 is lowered onto the inverse gear surface 176 to provide engagement. The ability to quickly and easily install the power module 130 at any time allows the apparatus 102 to be retrofitted with the power module 130 at a later time. In addition, the power module 130 can be quickly and easily removed for servicing the power module 130 without rendering the apparatus 102 inoperable. In addition, since the power module 130 can be easily removed, the apparatus 102 can be readily cleaned using a liquid without risking damage to the power module 130. As discussed above and illustrated in FIG. 10, a blank cover 182 can be installed to cover the power module receiving pocket 132 when the power module 130 is not installed. The blank cover 182 can be similar to the power cover portion 140 of the power module 130 in that it conforms to the shape and design of the cover assembly 106.

Referring still to FIG. 10, the apparatus 102 can be configured to include an exemplary fragrance module 200 and an exemplary fan assembly 202. The fragrance module 200 is configured to house one or more of various fragrance systems, such as a passive or active fragrance system that includes at least one of a fragrance and a deodorizer for emission from the apparatus 102. The fan assembly 202 provides a source of rapid airflow through the fragrance module 200 to assist with dispersing the fragrance and/or deodorizer, wherein the fan assembly 202 can be powered without electricity by engaging the lid 108.

The fragrance module 200 can be utilized with or without the fan assembly 202. Similar to the modular concept of the power module 130, the fan assembly 202 can be quickly and easily installed or removed at any time. As such, the fan assembly can be purchased subsequent to the apparatus 102, reducing initial product cost. Additionally, the fragrance module 200 and the fan assembly 202 can be quickly and easily removed for cleaning the apparatus 102, repairing the fan assembly 202, and refilling the fragrance module 200.

Figure 11:
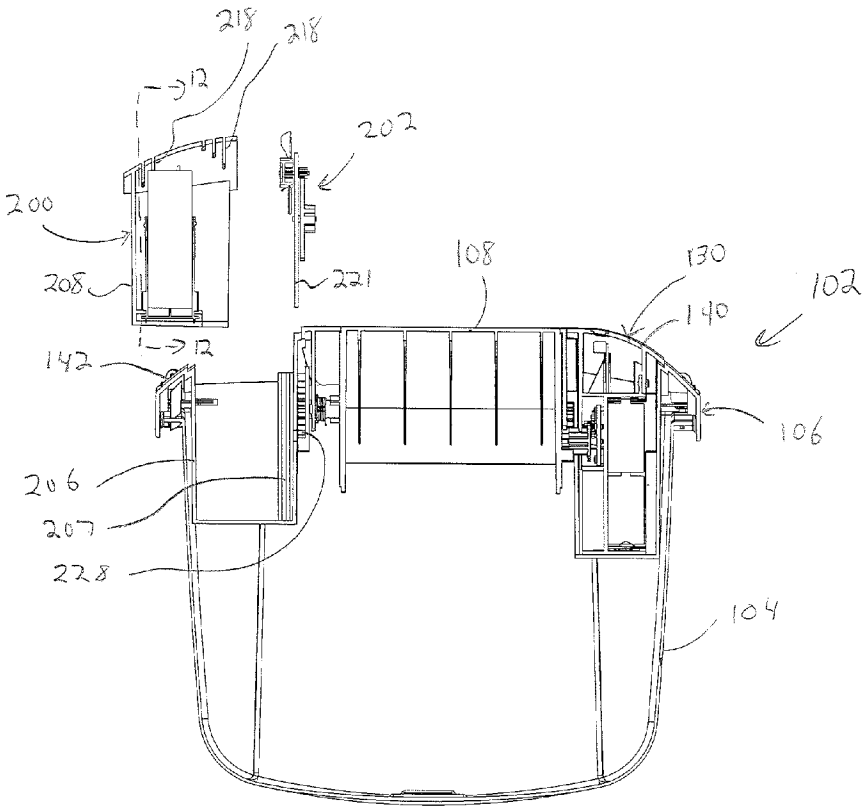
FIG. 11 illustrates a cross-sectional front view of the apparatus of FIG. 1 taken along a line similar to line 5-5 of FIG. 2 with an exemplary fragrance module and an exemplary fan assembly displaced from the apparatus.

FIG. 11 illustrates a cross-sectional front view of the apparatus 102 of FIG. 10, with the fragrance module 200 and fan assembly 202 displaced from the cover assembly 106. The cover assembly 106 includes a fragrance receiving pocket 206 for receiving the fragrance module 200 and fan assembly 202. The fragrance receiving pocket 206 extends from the cover assembly 106 towards the bin 104. In addition, the fragrance receiving pocket 206 includes one or more slots 207 configured to receive and secure the fan assembly 202. A cross-sectional view of the fragrance module 200 taken at line 12-12 of FIG. 11 is provided in FIG. 12. The fragrance module 200 includes a fragrance module housing 208 that supports various components of the fragrance module 200. The fragrance module housing 208 is sized and shaped to be received and secured in the fragrance receiving pocket 206. The fragrance module housing 208 includes a fragrance cover portion 210 that is, in at least some embodiments, sized and shaped to conform to the upper surface 142 of the cover assembly 106 to provide an aesthetic match. The fragrance cover portion 210 includes a plurality of vents 218 for the intake and exhaust of air through the fragrance module 200. In at least some embodiments, the fragrance system is a passive wick system 212 that disperses fragrance. The wick system 212 includes a wick holder 214 and a wick 216 inserted into the wick holder 214.

Figure 13:
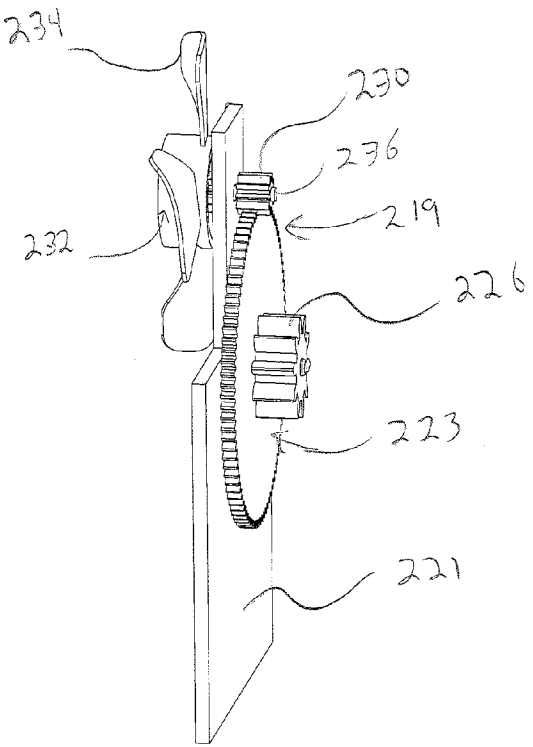
FIG. 13 illustrates a perspective view of the fan assembly.

Turning to FIG. 13, a perspective view of the fan assembly 202 is illustrated. The fan assembly 202 includes a support portion 222 having a shape and size configured to be received in the slots 207 situated in the fragrance receiving pocket 206. Although the support portion 222 is shown as a planar structure, the support portion 222 can include various other shapes and sizes along with alternate securing mechanisms in the fragrance receiving pocket 206 that differ from the slots 207. The fan assembly 202 further includes a fan gear assembly 219 with a fan lid engaging gear 223 that includes a lid engaging portion 226 for engaging an inverse fan gear surface 228 (FIG. 11) that is secured to or formed with the left side portion 117 of the lid 108. The inverse fan gear surface 228 extends in an arc along the left side portion 117 of the lid 108. The configuration of the fan lid engaging gear 223 with the inverse fan gear surface 228 provides an interconnection that can be completed upon insertion of the fan assembly 202 into the slots 207, such that the fan lid engaging gear 223 is lowered onto the inverse fan gear surface 228 to provide engagement. When the fan assembly 202 is installed, rotation of the lid (opening or closing) rotates the fan lid engaging gear 223, which in turn rotates a fan gear 230 engaged with the fan lid engaging gear 223. A fan 232, having one or more fan blades 234, is connected via a fan shaft 236 to the fan gear 230. Rotation of the fan gear 230 thereby rotates the fan blades, generating airflow through the fragrance module 200 to assist the fragrance system. Although a specific gearing mechanism is illustrated, various other mechanisms, such as a belt mechanism, can be utilized to rotate the fan blades 234 upon actuation of the lid 108. As discussed above, the fan assembly 202 provides a manually driven airflow mechanism that can be utilized each time the lid 108 is actuated, whether the lid is manually actuated or electronically actuated using the power module 130. The fan assembly 202 can be utilized to eliminate the need for additional fragrance systems, such as electronic models mounted in the same room as the apparatus 102. The fan 232 and fan blades 234 can include various styles of fans not depicted, such as a squirrel-cage fan. The fan gear assembly 219, including the fan lid engaging gear 223 and the fan gear 230, are configured to provide a high ratio of input to output gearing. In at least some embodiments, the fan gear assembly 219 provides about 12 to about 300 revolutions of the fan blades upon opening and closing of the lid 108. In at least some embodiments, the rotation of the fan blades 234 can be in the range of 747 revolutions per minute (RPMs). The RPMs can be varied depending on the airflow needs and space requirements by utilizing different gear ratios.

Various sensors and control configurations can be utilized to provide systematic dispersion of fragrance and/or deodorizer. For example, a day/night light sensor (not shown) can be provided that senses if a room light is on (sensing that the room housing the apparatus 102 is occupied) and then sensing when the light is turned off (sensing that the room is no longer occupied). Upon sensing that the room is no longer occupied, the power module 130 could be automatically activated to open and close the lid 108, thereby activating the fan assembly 202 to rotate the fan blades and disperse fragrance and/or deodorizer. In addition, the apparatus 102 can be programmed to activate the power module 130 on a scheduled basis.

Figure 16:
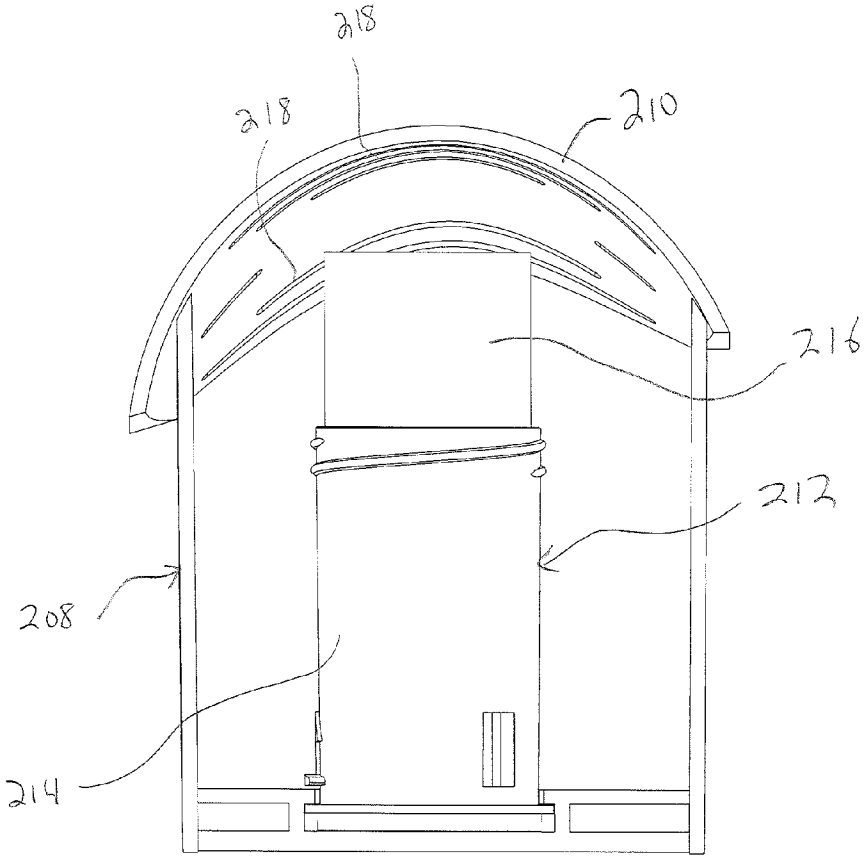
FIG. 16 illustrates a rear view of the apparatus shown in FIG. 15.
Figure 14:
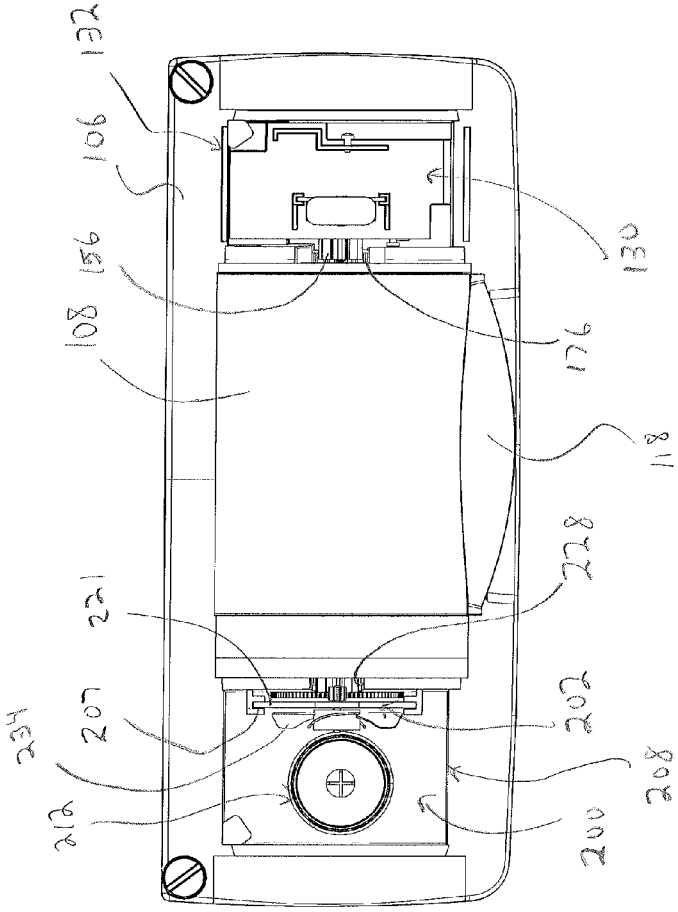
FIG. 14 illustrates a partial top view of the apparatus.
Figure 15:
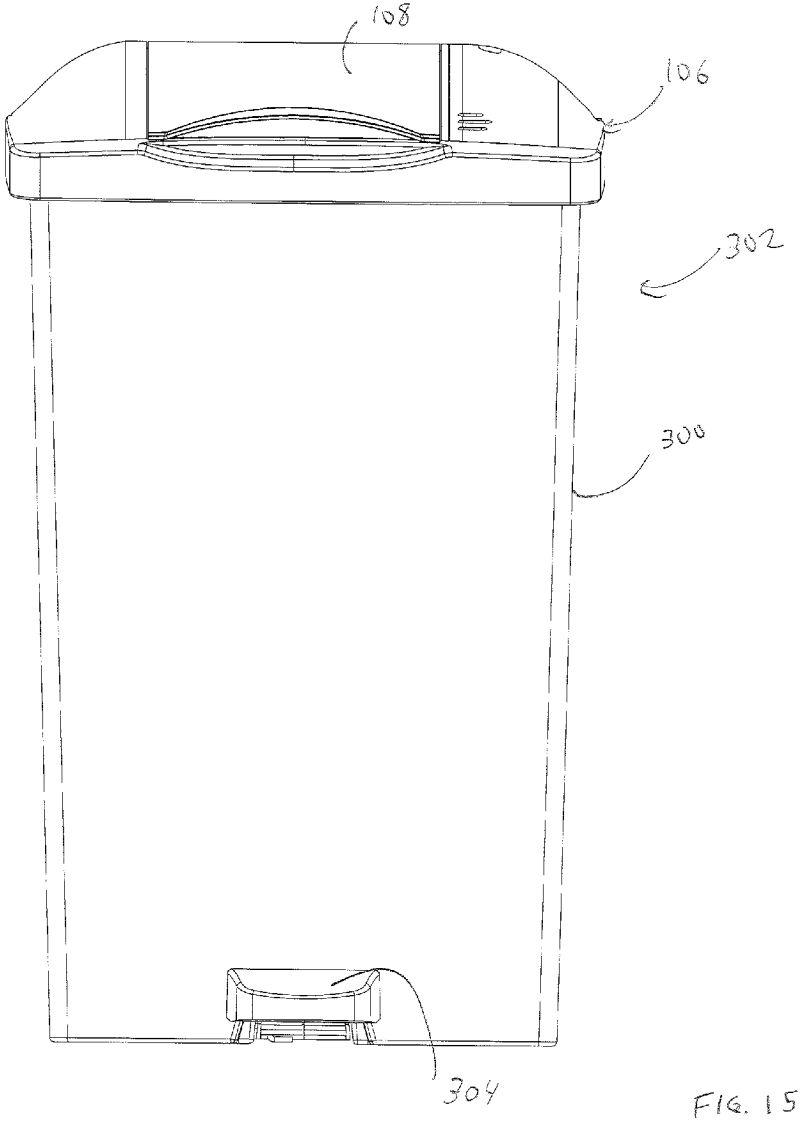
FIG. 15 illustrates a front view of another embodiment of the apparatus with an elongated storage bin and a foot pedal.
Figure 16:
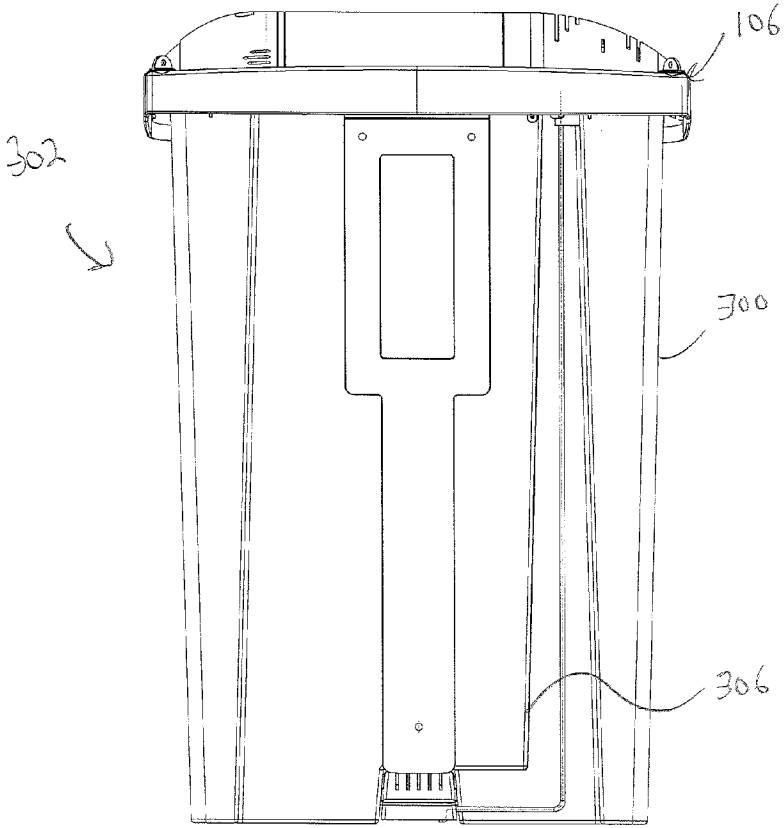

FIG. 14 provides a top view of the apparatus 102 with the power cover portion 140 and the fragrance cover portion 210 removed to provide another view of the arrangement of the power module 130, the fragrance module 200, and fan assembly 202. Although the apparatus 102 can be configured for wall mounting, in at least some embodiments, the apparatus 102 can be configured as a floor standing apparatus as seen in FIG. 15. More particularly, the cover assembly 106 can be installed on an elongated bin 300 to provide a standing apparatus 302. The standing apparatus 302 includes a foot pedal 304 interconnected via one or more rods 306 (FIG. 16) to the lid 108 to allow actuation of the lid 108 without touching the lid 108. FIG. 16 illustrates a rear view of the apparatus shown in FIG. 15.

The bin 104 can include none of or any combination of the fan assembly 202, the fragrance module 200, and the power module 130. Additionally, the substantially cylindrical lid 108 can be excluded or replaced with another style lid, such as an envelope or flat covering. Further, the power module 130, fragrance module 200 and fragrance module 200 are protected from bin contamination due to the power module receiving pocket 132 and the fragrance receiving pocket 206. The modular configuration of the power module 130, fan assembly 202, and fragrance module 200 allow for a quick swap of the modules from a dirty bin to a cleaned bin, thus providing a substitute bin that retains the desired features, while the original bin is being cleaned or serviced.

It is specifically intended that the disposal apparatus and method of use not be limited to the embodiments and illustrations contained herein, but include modified forms of those embodiments including portions of the embodiments and combinations of elements of different embodiments as come within the scope of the following claims.

We claim:

1. A product disposal apparatus comprising:

a bin for receiving discarded products;

a cover assembly including a lid, wherein the cover assembly is position at least partially over bin;

a power module receiving pocket situated at least partially within the cover assembly, for receiving one of a power module and a power shell module; and a fragrance receiving pocket situated at least partially within the cover assembly, for receiving one of a fragrance module and a fragrance shell module, wherein a fan assembly with fan blades is positioned adjacent the fragrance module and interconnected with the lid, wherein actuation of the lid rotates the fan blades.

2. The apparatus of claim 1 wherein the lid contains a plurality of ridges on an inner lid wall.

3. The apparatus of claim 1 wherein the cover assemblly includes a motion detector.

4. The apparatus of claim 1 wherein the fan assembly includes a fan lid engaging gear, a lid engaging gear and a fan gear.

5. The apparatus of claim 1 wherein the fan assembly and fragrance receiving pocket are at least partially covered by a fragrance cover having at least one vent.

6. The apparatus of claim 1 wherein the lid includes a partially cylindrical shape and is rotatably secured to the cover assembly.

7. The apparatus of claim 6 wherein the lid comprises a right side portion, a la side portion, a front portion and a back portion defining a hollow cavity accessible by a lid opening.

8. The apparatus of claim 1 in which the power module is mechanically engaged with the lid.

9. The apparatus of claim 8 which further includes an electric motor.

10. The apparatus of claim 9 which further includes a power gear assembly.

11. The apparatus of claim 10 wherein the power gear assembly comprises an intermediate gear which engages a motor shaft gear and power engaging gear.

12. The apparatus of claim 11 wherein the cover assembly further includes an arced inverse gear surface, and wherein the power engaging gear engages the arced inverse gear surface.

13. product disposal apparatus comprising:

a bin for receiving discarded products:

a bin opening provided at a top portion of the bin;

a cover assembly positioned at least partially over the bin opening:

a lid rotatably secured to the cover assembly, wherein the lid includes a partially cylindrical shape having a front portion and a back portion, and wherein a back portion of the lid is positioned to at least partially cover the bin opening as the lid is rotated into an open position;

a fragrance receiving pocket at least partially situated in the cover assembly, for receiving a fragrance module; and a fan assembly with fan blades, the fan assembly positioned adjacent the fragrance module and interconnected with the rotating lid, wherein rotation of the lid rotates the fan blades to assist with dispersion of a fragrance system situated in the fragrance module.

14. The product disposal apparatus of claim 13, further comprising a power module receiving pocket situated at least partially within the cover assembly, and for receiving one or a power module and a power shell module.

15. The apparatus of claim 13, wherein rotation of the fan blades occurs without the use of electric power.

16. The apparatus of claim 15, wherein the tan assembly is modular.

17. A method of deodorizing a hygiene disposal apparatus comprising:

providing a hygiene disposal apparatus including: a bin for receiving discarded hygiene products; a cover assembly including a lid, the cover assembly positioned at least partially over the bin; a fragrance module positioned at least partially within the cover assembly; and a fan assembly positioned adjacent to the fragrance module;

opening the lid to access an interior of the bin by at least one of rotating or lifting the lid; the opening of the lid causing one or more fan blades of a fan situated adjacent to the flagrance in to rotate.

18. The method of claim 17,wherein the hygiene disposal apparatus further includes at least one gear engaged by or with a portion of the lid and interconnected a fan assembly fan; and the method includes using the at least one gear to rotate the fan situated adjacent to the fragrance module.

19. The method of claim 18, wherein the lid may be opened or closed and, during the opening and/or closing of the lid, the rotation of the fan blades exceeds 500 revolutions per minute without the use of electricity.

* * * * *

UNITED STATES PATENT AND TRADEMARK OFFICE

CERTIFICATE OF CORRECTION

PATENT NO. : 8,845,970 B2
APPLICATION NO. : 13/828410
DATED : September 30, 2014
INVENTOR(S) : Todd J. Muderick et al.

It is certified that error appears in the above-identified patent and that said Letters Patent is hereby corrected as shown below:

In the Claims,

Claim No. 1

Column 7, line 36, replace "position" with --positioned--

Column 7, line 36, insert --the-- after "over"

Claim No. 7

Column 7, line 60, replace "la" with --left--

Claim No. 13

Column 8, line 13, insert --A-- at the beginning before "product"

Claim No. 16

Column 8, line 37, replace "tan" with --fan--

Claim No. 17

Column 8, line 50, replace "flagrance in" with --fragrance module--

Signed and Sealed this
Third Day of February, 2015

Michelle K. Lee

Michelle K. Lee
*Deputy Director of the United States Patent and Trademark Office*